US005667422A

United States Patent [19]

Erwin

[11] Patent Number: 5,667,422

[45] Date of Patent: Sep. 16, 1997

[54] AN UNDERGARMENT TO BE WORN UNDERNEATH A BRASSIERE

[75] Inventor: Doris Diann Erwin, Houston, Tex.

[73] Assignee: The Undrbra, Inc., Livingston, Tex.

[21] Appl. No.: 425,981

[22] Filed: Apr. 17, 1995

[51] Int. Cl.[6] ..... A41B 9/06; A41B 9/16

[52] U.S. Cl. ..... 450/30; 2/73

[58] Field of Search ..... 2/73, 75, 105, 2/106, 107, 109, 110, 112, 113, 114, 115; 450/1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 70

[56] References Cited

U.S. PATENT DOCUMENTS

| | | | |
|---|---|---|---|
| 709,200 | 9/1902 | Buckley | 2/73 |
| 1,077,188 | 10/1913 | Condit | 2/113 |
| 1,524,491 | 1/1925 | Sprenger | 2/113 |
| 2,377,004 | 5/1945 | Hanes | 2/113 X |
| 2,719,303 | 10/1955 | Lodenius | 2/107 X |
| 3,064,265 | 11/1962 | Bridgewaters | 2/105 X |
| 4,909,771 | 3/1990 | Bergman | 450/70 X |

OTHER PUBLICATIONS

Victoria Secret, Spring 1992, vol. No. 10 London WI, pp. 68, 30 and 31.

"Super Sumer Sale", Bike Nashbar, Summer of 1991, vol. 76.

*Primary Examiner*—Jeanette E. Chapman

[57] ABSTRACT

There is provided an undergarment and a method for clothing a lady with an undergarment. The method of use is carried out by positioning the undergarment on the upper body and then positioning a brassiere over a portion of the undergarment. The undergarment is positioned so that a lowermost portion of the front seam portion is positioned about 7 inches below the top of the sternum. The lowermost portion of the back seam portion is positioned about 10 inches below the seventh cervical vertebrae. The lowermost portion of each arm hole seam is positioned about 3 inches below the arm pit. The brassiere is then positioned over the undergarment.

4 Claims, 5 Drawing Sheets

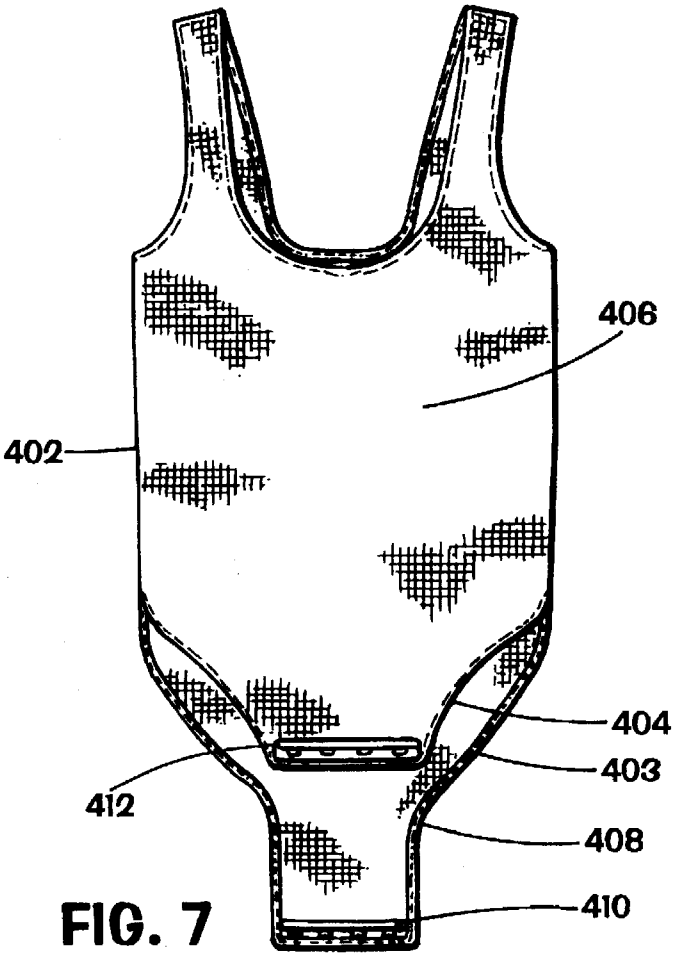
FIG. 7
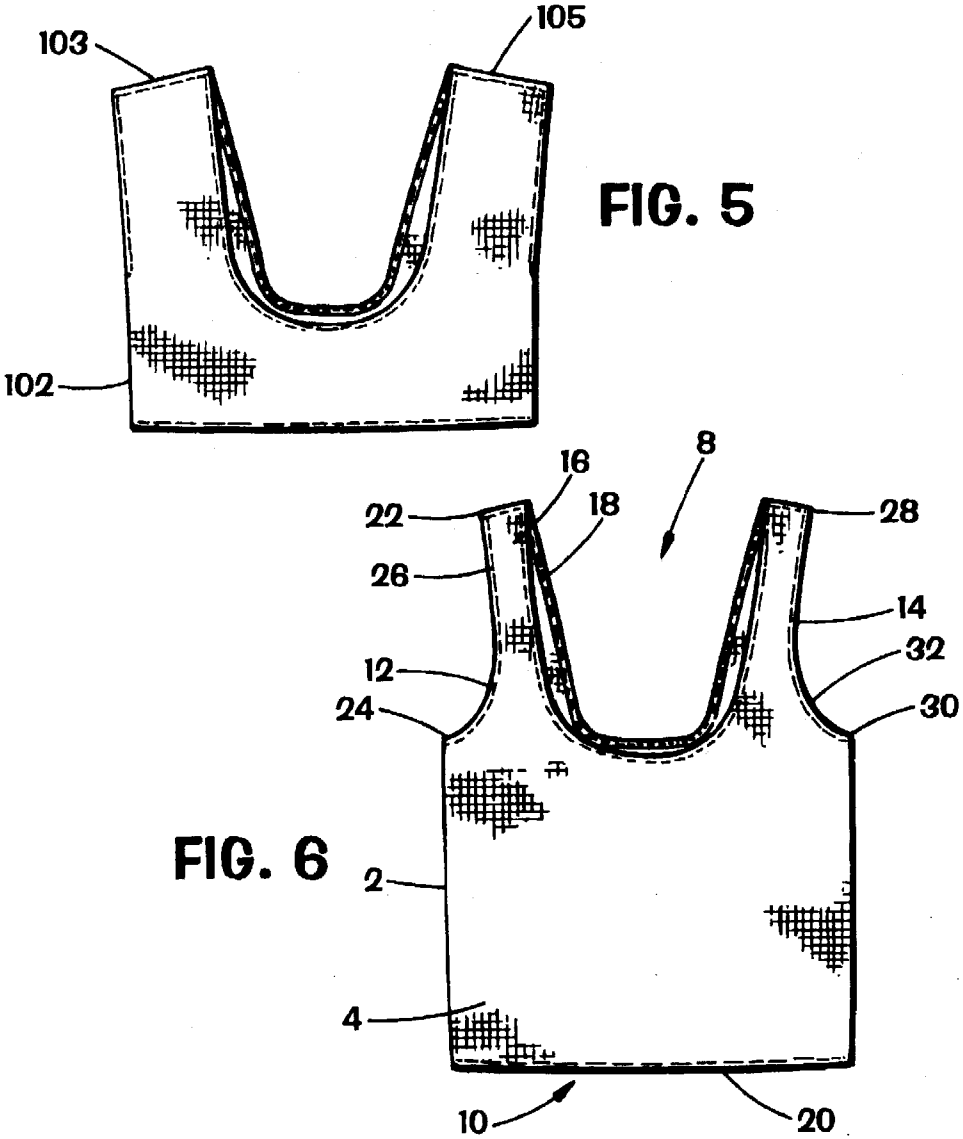
FIG. 6
FIG. 5

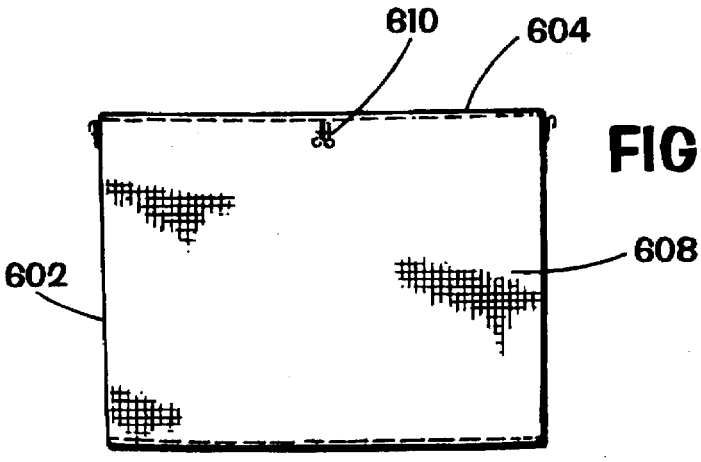
FIG. 13
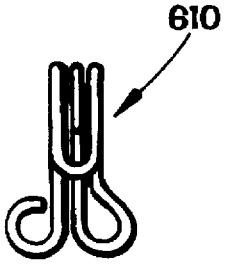
FIG. 14
FIG. 15
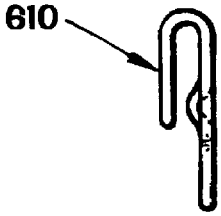
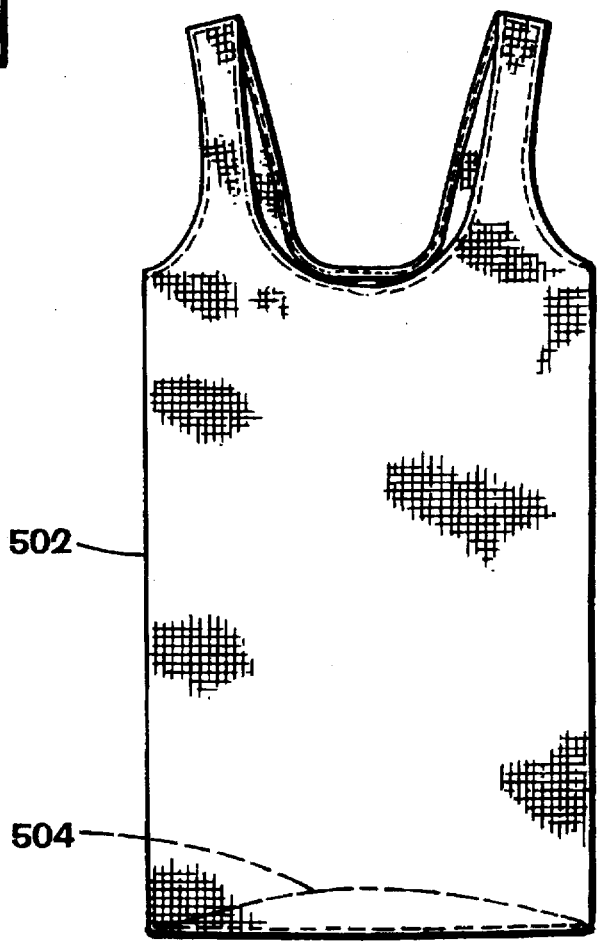
FIG. 16
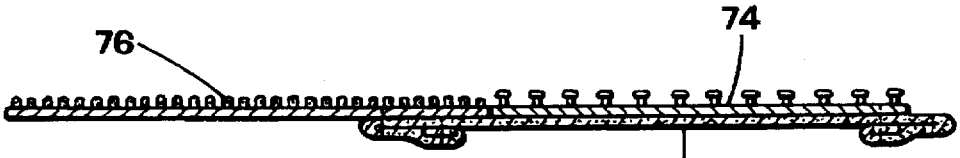
FIG. 17

AN UNDERGARMENT TO BE WORN UNDERNEATH A BRASSIERE

BACKGROUND OF THE INVENTION

This invention relates to a lady's undergarment. In one aspect, this invention relates to a lady's undergarment well suited to be worn underneath a brassiere. In another aspects, this invention relates to a new way to wear a lady's brassiere.

There is no garment on the market today that gives a woman relief from the discomfort associated with wearing a bra. They chafe, pinch, dig, push, bind and squeeze. Women with large breasts, weight problems, or other sensitivities due to sunburn, surgery, skin infections, for example, have greater degrees of discomfort.

An undergarment to provide a user with comfort when wearing a brassiere would be very desirable.

Some efforts have been made to provide comfortable brassieres. However, brassieres are expensive and many women are brand conscious and reluctant to change. An undergarment that can be used with any brand of brassiere would be very attractive.

It is known that some lady's swim suits have upper lines which are similar to the upper lines of the undergarment of the invention. However, swim suits are not suitable for wearing underneath brassieres for a number of reasons. It is also known that some styles of shirts, such as tank tops, also have upper lines similar to those of the invention. However, these shirts invariably show under or through street clothes and are thus unsuitable for use as undergarments.

OBJECTS OF THE INVENTION

It is an object of this invention to provide an undergarment for use with a brassiere.

It is a further object of this invention to provide an undergarment to line a brassiere to increase the comfort of wearing a brassiere.

It is another object of this invention to provide an undergarment for lining a brassiere which can be used with any brand of brassiere.

It is another object of this invention to provide an undergarment which can be worn under a brassiere and is nearly invisible under street clothes.

It is another object of this invention to provide a new way to wear a brassiere which provides increased comfort.

It is another object of this invention to provide a closure for a body type undergarment which fastens on the abdomen.

It is another object of this invention to provide a lined brassiere which provides lining for the under wires and straps, and also for the user's pants.

SUMMARY OF THE INVENTION

In a first embodiment of the invention, there is provided lady's undergarment to be worn on the upper body. The undergarment has a front side and a back side and is formed from a tubular fabric material.

The tubular fabric material defines an upper opening, a lower opening, a first arm hole, and a second arm hole. The upper opening is formed by a neck hole. The neck hole is defined by a neck hole seam having a front seam portion and a back seam portion. The lower opening is a single opening for receipt of a lower portion of the body and is defined by a bottom seam. The first arm hole has an upper end and a lower end and is defined by a first arm hole seam, and the second arm hole also has an upper end and a lower end and is defined by a second arm hole seam. Straps are formed between the neck hole seam and the arm hole seams. The front seam portion is generally U shaped and forms a generally U shaped slot having a length in the range of from about 10 inches to about 14 inches. The back seam portion is generally U shaped and forms a generally U shaped slot having a length in the range of from about 9 inches to about 16 inches. Each arm hole seam follows an arcuate path from the top of the armhole to the bottom of the armhole.

Specifically there is provided a lady's undergarment formed from a tubular fabric material defining an upper opening and a lower opening. A neck hole forms the upper opening. The neck hole is defined by a neck hole seam. The neck hole seam has a front seam portion positioned on a front side of the undergarment, and a back seam portion positioned on a back side of the undergarment. The front seam portion is generally U shaped and a lowermost portion of the front seam portion passes beneath a point at least 2 inches below the front arm's eye line or below the arm pit area of the wearer. The back seam portion is also generally U shaped and a lowermost portion of the back seam portion passes beneath a point at least 2 inches below the back arm's eye line or below the arm pit area of the wearer. The lower opening of the lady's undergarment is in the form of a single opening for receipt of the lower portion of the body.

The method for wearing the above undergarment is that the undergarment is positioned the upper body and then a brassiere is positioned over the undergarment. The undergarment is positioned so that a lowermost portion of the U-shaped front seam portion is positioned at least about 7 inches below the top of the sternum and this seam is positioned well below a top front center of a brassiere. The lowermost portion of the U-shaped back seam portion is positioned about 10 inches below the seventh cervical vertebrae. The lowermost portion of each arm hole seam is positioned at least about 3 inches below the arm pit. The brassiere is then positioned over the undergarment.

BRIEF DESCRIPTION OF THE DRAWINGS

FIG. 5 is a plan view of a cropped version of the undergarment.

FIG. 6 is a plan view of the undergarment shown in FIG. 1.

FIG. 7 is a plan view of a body version of the undergarment.

FIG. 13 is a plan view of a strapless version of the undergarment having hooks near the upper end.

FIG. 14 is a detail of a hook shown in FIG. 13.

FIG. 15 is a side view of the hook shown in FIG. 14.

FIG. 16 is a plan view of a slip version of the undergarment showing a shortened back side by the dotted line.

FIG. 17 is a cross sectional view of the strap fastener shown in FIG. 10.

DETAILED DESCRIPTION OF THE PREFERRED EMBODIMENTS

Figure 1:
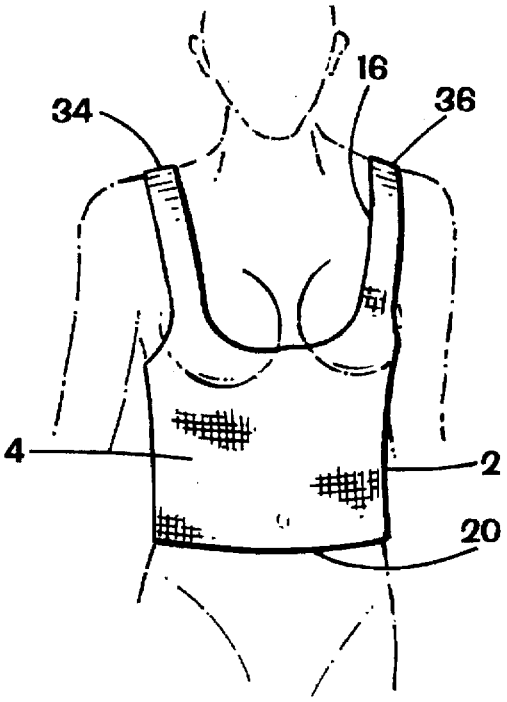
FIG. 1 is a front view of one embodiment of the undergarment when in use.
Figure 2:
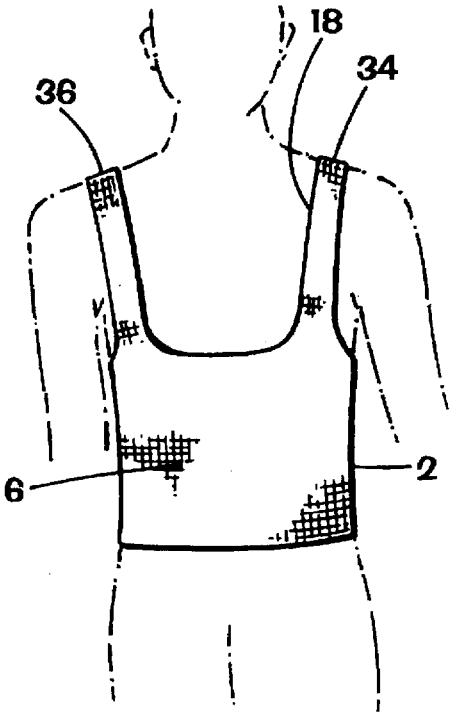
FIG. 2 is a back view of the embodiment shown in FIG. 1.
Figure 3:
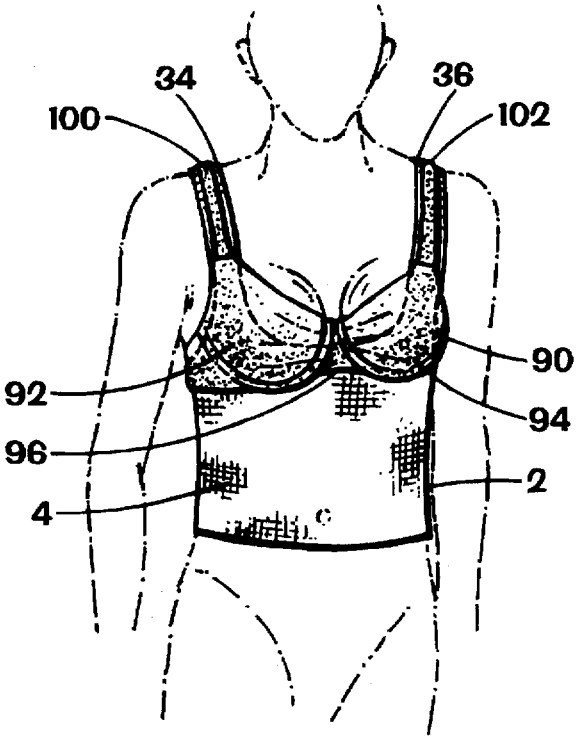
FIG. 3 is a front view of the embodiment of the undergarment shown in FIG. 1 when used to underline a brassiere.

In a first embodiment of the invention, and as best shown by FIGS. 1, 2 and 6, there is provided lady's undergarment 2 to be worn on the upper body. The undergarment has a front side 4 and a back side 6 and is formed from a tubular fabric material.

The tubular fabric material defines an upper opening 8, a lower opening 10, a first arm hole 12, and a second arm hole 14. The upper opening is formed by a neck hole. The neck hole is defined by a neck hole seam having a front seam portion 16 and a back seam portion 18. The lower opening is a single opening for receipt of a lower portion of the body and is defined by a bottom seam 20. The first arm hole 12 has an upper end 22 and a lower end 24 and is defined by a first arm hole seam 26, and the second arm hole 14 also has an upper end 28 and a lower end 30 and is defined by a second arm hole seam 32. Straps 34 and 36 are formed between the neck hole seam and the arm hole seams.

The front seam portion 16 is generally U shaped and forms a generally U shaped slot having a length in the range of from about 10 inches to about 14 inches, preferably in the range of about 11–13 inches. The back seam portion 18 is generally U shaped and forms a generally U shaped slot having a length in the range of from about 9 inches to about 16 inches, preferably in the range of 10 inches to about 13 inches. Each arm hole seam 26 and 32 follows an arcuate path from the top of the armhole to the bottom of the armhole and forms a slit which in the range of from about 9 inches to about 14 inches in length, preferably in the range of from about 10 inches to 13 inches in length, most preferably 11½ or 12. These measurements are when the undergarment is folded flat as shown in FIG. 6 and are in longitudinal direction, not following the curves.

Although the undergarment can be formed from many types of materials, it is preferred that a tubular material be used, because of the absence of side seams, to reduce potential discomfort and visibility under street clothes. It is also preferred that the material be stretchable, so that it can be stretched to fit and will tend to stay in position. It is more important in providing a good fit that the material be stretchable circumferentially more than it stretches longitudinally. A 100% cotton fabric having a stretchability in the range of from about 10% to about 50% along the warp and in the range of from about 50% to about 200% along the weft is expected to provide very good results. A lightweight cotton underwear material should be highly suitable. It can be doubled in thickness if desired for increased comfort. Any desired coloration can be used, but is preferably selected with concealment in mind when worn under street clothes.

Generally speaking, the tubular fabric material will have a circumference in the range of from about 14 inches to about 60 inches, depending on stretchability and the size of the user. Usually, the tubular fabric material forming the body will have a circumference in the range of from about 20 inches to about 35 inches. Preferably, the tubular material is sized to snugly fit the user, and flat seams are used.

As measured from the tops of the straps to the seam at the bottom opening the undergarment may have a length varying over a wide range.

A cropped undergarment 102 as shown in FIG. 5 can have a length in the range of from about 13 inches to about 20 inches as measured from the top of the straps to the bottom of the hem. It is designed for use with bare midriff street clothes. The undergarment in FIG. 5 further optionally comprises a first wide strap 103 and a second wide strap 105. The armholes are optionally not as large as in the other described embodiments, generally extending to about only 1 inch below the armseye line. The small armholes are preferred in this embodiment, to control perspiration. When wide straps are used, it can be desirable to employ a wider neck hole, to decrease the visibility of the undergarment.

The undergarment 2 as shown in FIGS. 1–4, 6, and 8 can have a length as in the range of from about 18 inches to about 26 inches, preferably in the range of from about 20 inches to about 24 inches. It should have a length sufficient to permit the tail to be tucked into the use's pants or panties.

Figure 9:
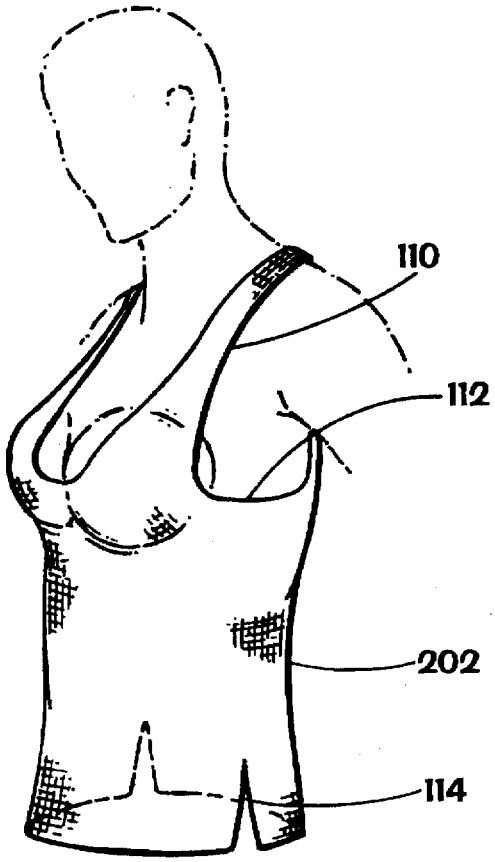
FIG. 9 is a pictorial representation of another version of the undergarment, with modified armholes and lower side vents.

The undergarment 202 shown in FIG. 9 is the classic full body model. It can also have a length in the range of from about 18 to about 26 inches, preferably in the range of from about 20 inches to about 24 inches.

Figure 8:
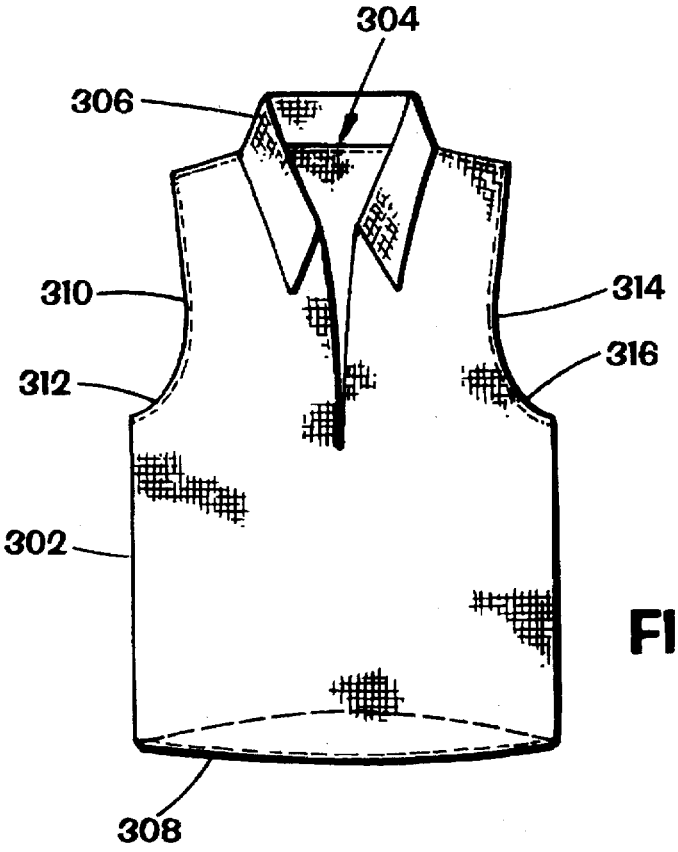
FIG. 8 is a plan view of a collared version of the undergarment.

The undergarment 302 shown in FIG. 8 is the fashion collar model. It can also have a length in the range of 18 inches to 26 inches, preferably about 20–24 inches.

The undergarment 502 shown in FIG. 16 is the classic slip model. It will generally have a length in the range of from about 28 to 45 inches. The undergarment 502 is cut longer on the front side, shorter at the bottom 504 of the back side, so that the hem will hang straight.

It is preferred that the front side be 1 inch to about 6 inches longer than the back side in all of the models. The above length measurements are taken on the front side of the undergarment.

From the viewers perspective, it is easiest to define the features of the invention when in use by reference to the arm's eye line. A human body has an upper portion, a lower portion, and a pair of arms and a line as measured closely beneath the pair of arms. It is this line that is referred to as the arm's eye line. There is a front arm's eye line and a back armseye line.

The simplest form of the undergarment according to the invention is shown in FIG. 13. The undergarment shown in FIG. 13 is designed for a strapless dress. The upper end of the back side may be cut (not shown) to reduce visibility when worn with a low backed dress. Generally speaking, the upper end of the back side of the undergarment will be positioned lower than 2 inches below the back arm's eye line, preferably lower than 3 inches, and sometimes much lower, such as for use with a backless gown. In FIG. 13, an undergarment 602 comprises a tubular fabric material having a circumference in the range of from about 14 inches to about 60 inches, a first end 604, and a second end 606, an inner surface, and an outer surface 608, and a hook 610 positioned on the outer surface 608 near the first end 604 for securing the undergarment to a brassiere when worn over the undergarment. Preferably, the undergarment 602 has a length in the range of from about 4 inches to about 12 inches on the front side. Preferably, a plurality of hooks 610 are used.

The hooks are preferably used in all embodiments of the invention. Preferably, an outer hook is present on the outside surface of the undergarment near the front lower end of the neck hole so that the undergarment can be hooked over the upper edge of brassiere between the cups. An eyelet can be sewn into the brassiere to better accommodate the hook on the undergarment.

The collared version 302 of the undergarment as shown in FIG. 8 is formed from a tubular fabric material defining an upper opening 304, a collar 306 attached to the upper opening, a lower opening 308, a first arm hole 310 defined by a first arm hole seam 312 and a second arm hole 314 defined by a second arm hole seam 316. Each of the first arm hole 310 and the second arm hole 314 has an upper end adjacent to an upper end of the undergarment and a lower end. The arm hole seam at the lower end of each said arm hole passes to a point at least 2 inches below the arm's eye line, preferably at least 3 inches below the armseye line. This low cut armhole reduces the possibility that the undergarment will be visible through the armhole of outer wear positioned thereover. The collar is open and V shaped and terminates at a position at least 2 inches below the arm's eye line, preferably at least 3 inches below the arm's eye line.

With reference to FIGS. 1 and 2, the front seam portion, 16 is generally U shaped and a lowermost portion of the front seam portion passes to a point at least 2 inches below the front armseye line, preferably at least 3 inches below the armseye line. The back seam portion 18 is also generally U shaped and a lowermost portion of the back seam portion passes to a point at least 2 inches below the back arm's eye line, preferably at least 3 inches below the back arm's eye line. The bottom seam 20 of the lady's undergarment defines the lower single opening of the undergarment for receipt of the lower portion of the body.

Preferably, the front seam portion seam 6 passes a point in the range of about 3 inches to about 5 inches below the front arm's eye line and the back seam portion passes to a point in the range of about 3 inches to about 6 inches below the back arm's eye line. About 3 inches is optimal, because most brassieres are also cut in this manner. The bottom of the arm holes 12 and 14 are similarly located. Each arm hole has an upper end adjacent to the upper end of the undergarment and a lower end, and the arm hole seam at the lower end of each said arm hole passes to a point at least 2 inches below the armseye line, preferably in the range of from about 3 inches to about 5 inches below the arm's eye line. This reduces the possibility that the undergarment will be visible through the armhole of street clothes.

The first strap 34 is defined between the neck hole seam and the first arm hole seam and the second strap 36 is defined between the neck hole seam and the second arm hole seam. Each of the first strap 34 and the second strap 36 has a width in the range of from about 1 inch to about 3 inches as measured between the neck hole seam the arm hole seam at the upper end of the undergarment. Preferably, each of the straps has a width in the range of from about 1 inch to about 2 inches at the upper end of the undergarment and each arm hole seam is generally parallel to the neck hole seam over a length of at least about 12 inches. Most preferably, the strap is about 1 and ¼ inches wide. This strap configuration makes the undergarment generally unsuitable for use as an outer garment. With reference to FIGS. 1 and 9 it is readily apparent that the undergarment of the invention does not provide adequate concealment for use as an outer garment by most people, in most circumstances.

Figure 10:
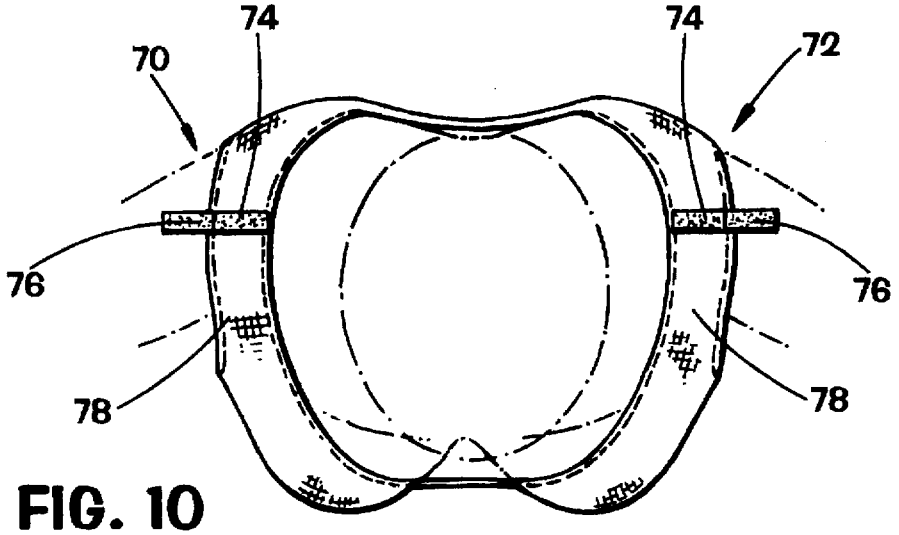
FIG. 10 is a pictorial representation of one embodiment of a strap fastener which can be used in the invention.
Figure 11:
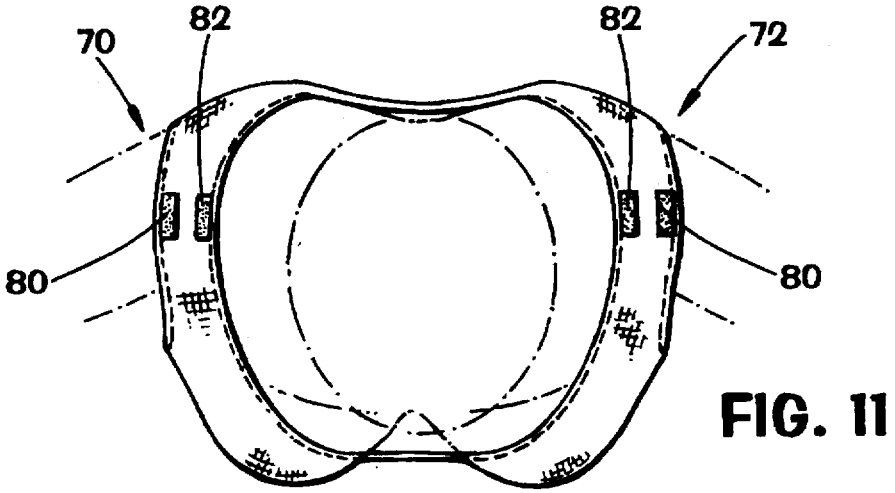
FIG. 11 is a pictorial representation of another embodiment of a strap fastener which can be used in the invention.
Figure 12:
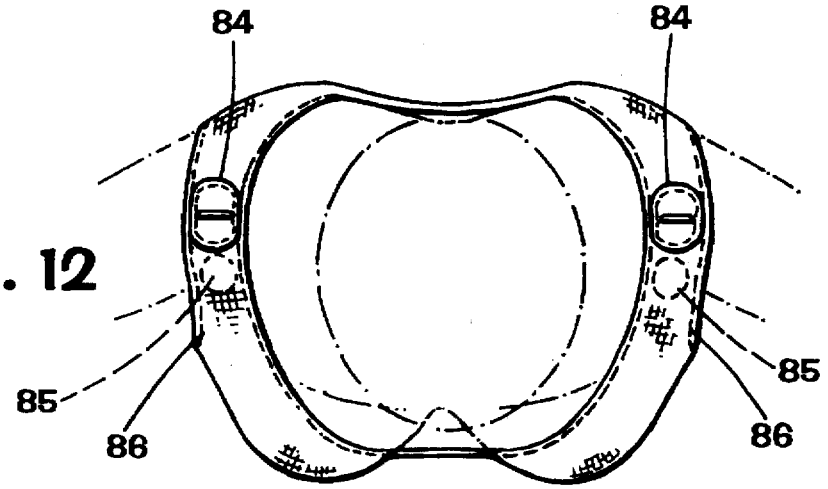
FIG. 12 is a pictorial representation of one embodiment of a shoulder pad which can be used in the invention.

Preferably, the straps of the undergarment are provided with means for securing a brassiere strap. FIGS. 10–11 show various means for securing the strap of a brassiere to the strap of the undergarment. Generally speaking, when this embodiment of the invention is carried out, the undergarment will comprise a first means for securing a brassiere strap positioned on the first strap and a second means for securing a brassiere strap positioned on the second strap. Hook and loop brand fasteners, VELCRO brand fasteners, are preferred, although snaps or buttons or the like could be used as well. In FIG. 10, and as detailed in FIG. 17, the hook strip 74 of a VELCRO fastener is affixed across a strap 78. If desired, the hook strip can be used by itself and will provide good results. If greater security is desired, the felt strip 76 of the fastener can also be attached to the strap 78 to provide a secure fastening mechanism to reliable place a brassiere strap. In the configuration shown in FIG. 11, mating VELCRO strips 80 and 82 are positioned along the edge of each strap. After the brassiere strap is positioned, the VELCRO strips can be attached together and the strap of the undergarment can be rolled in the desired direction to reduce visibility under street clothes. Other fastening configurations as possible and within the scope of the invention. FIG. 12 shows means 84 for cushioning the shoulder area under the brassiere straps. The cushioning means can comprise a pad positioned on or in the undergarment straps 86. In one embodiment, the cushioning means comprises pockets mounted to the straps 86. The pockets which may contain cushioning pads. In another embodiment, pads 85 are sewn into the straps.

Figure 4:
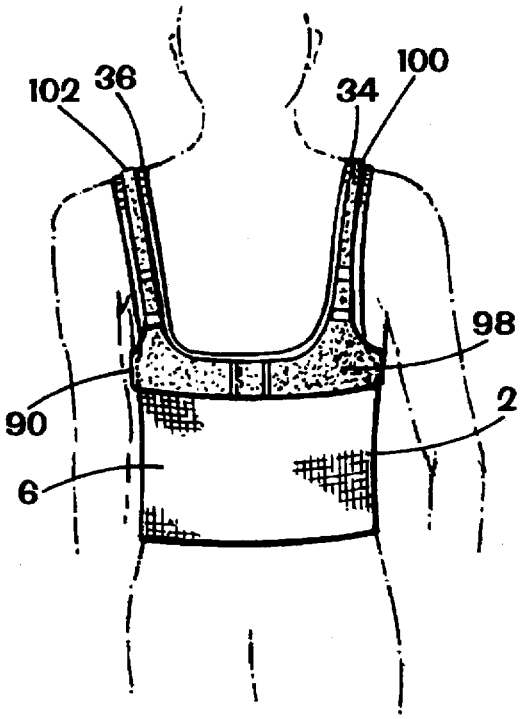
FIG. 4 is a back view of the embodiment shown in FIG. 3.

The undergarment is designed to be worn under a brassiere. In one embodiment, the brassiere is integral with the undergarment. In FIGS. 2 and 4, the brassiere 90 has an inner surface and an outer surface. The brassiere is positioned on an outer surface of the tubular fabric material forming the undergarment 2. The inner surface of the brassiere is positioned against the outer surface of the tubular fabric material. The brassiere 90 has a first cup 92, a second cup 94, a first means 96 for connecting the first cup with the second cup on the front side 4 of the undergarment 2, and a second means 98 for connecting the first cup 92 with the second cup 94 on the back side 6 of the undergarment 2. A first shoulder strap 100 connects the first cup 92 with the second means 98. A second shoulder strap 102 connects the second cup 94 with the second means 98. The first shoulder strap 100 and the second shoulder strap 102 are positioned on the first shoulder strap 34 and the second shoulder strap 36 of the undergarment 2.

In the embodiment of the invention shown in FIG. 9, the first arm hole seam and the second arm hole seam are generally D-shaped. Each armhole seam has a curved portion 110 and a straight portion 112. The straight portion 110 of the arm hole seam is positioned at the lower end of the arm hole. This feature provides greater comfort and concealment of the undergarment with street clothes. The FIG. 9 embodiment of the invention is also provided with vents at the lower end of the undergarment. The vents are preferably in longitudinal alignment with the armholes, and have a length in the range of from about 2 inches to about 6 inches.

A bodysuit model of an undergarment 402 is shown in FIG. 7. In the undergarment 402, the lower opening is defined by a bottom seam 403 which defines a front tongue 404 extending from the front side 406 of the undergarment 402 and a back tongue 408 extending from the back side of the undergarment. Each tongue tapers toward the lower end of the undergarment and has an inner surface and an outer surface. The undergarment 402 further comprises a first fastener half 410 on the inside surface of the back tongue near the lower end of the undergarment and a mating second fastener half 412 on the outside surface of the front tongue 404 near the lower end. The back tongue 408 is in the range of about 10 inches to about 16 inches longer than the front tongue 404 and preferably has a minimum width of about 3 inches. This permits the undergarment to be fastened on the front side of the users body. Preferably, hook fasteners are used, most preferably 4 in number.

In another embodiment of the invention, there is provided a method for clothing a lady with an undergarment. Generally speaking, the method of use is carried out by positioning the undergarment on the upper body and then positioning a brassiere over a portion of the undergarment. From the user's perspective, the description is easiest understood with reference to the top of the sternum, the big bone at the back of the neck (the seventh cervical vertebrae), the arm pit, and the navel. The undergarment is positioned so that a lowermost portion of the front seam portion is positioned at least about 6 inches below the top of the sternum, preferably at least about 7 inches below the top of the sternum. The lowermost portion of the back seam portion is positioned at least about 9 inches below the seventh cervical vertebrae, preferably at least about 10 inches below the seventh cervical vertebrae. The lowermost portion of each arm hole seam is positioned at least about 2 inches below the arm pit, preferably at least about 3 inches below the arm pit. The brassiere is then positioned over the undergarment.

Preferably, the brassier has a pair of straps and the undergarment has a pair of straps defined between the neck hole seam and the arm hole seams of the undergarment. Each strap of the undergarment will have a width in the range of from about 1 inch to about 2 inches as measured between the neck hole seam the each arm hole seam. The straps of the undergarment are positioned on the on the shoulders of the user and the straps of the brassiere are positioned on the straps of the undergarment.

For maximum comfort, it is desirable to adjust the brassier on the undergarment. Where the brassiere has a front portion, a pair of side portions, and a back portion, each such portion having an upper end and a lower end, adjustment is made by positioning the lower end of the front portion of the brassiere over the undergarment. The upper end of each of the side portions of the brassiere are positioned over the undergarment. The upper end of the back portion of the brassiere is positioned over the undergarment.

Where the embodiment of the invention as shown in FIG. 7 is used, the fastener half on the front tongue is attached to the fastener half on the back tongue at a fastening position in the range of no more than about 8 inches beneath the navel, preferably in the range of about 6 inches to about 7 inches beneath the navel.

I claim:

1. A method to provide relief from chafing, pinching, binding and squeezing when wearing a brassiere said method comprising positioning an undergarment on an upper body of a wearer, said undergarment being formed from a tubular fabric material defining a upper opening, a lower opening, a pair of arm holes defined by arm hole seams, and a pair of straps, each strap being positioned between said upper opening and one of said pair of armholes, wherein a neck hole is the upper opening, said neck hole being defined by a neck hole seam having a front seam portion positioned on a front side of the undergarment, and a back seam portion positioned on a back side of the undergarment, wherein the front seam portion is generally U shaped when said undergarment is worn and a lowermost portion of the front seam portion is positioned at least inches below the top of the sternum of the wearer; and wherein the back seam portion is generally U shaped and when said undergarment is worn a lowermost portion of the back seam portion is positioned at least 10 inches below the seventh cervical vertebrae of the wearer;

and wherein a lowermost portion of each arm hole seam is positioned at least about 3 inches below the arm pit when said undergarment is worn;

positioning a brassiere over an upper portion of the undergarment;

securing a front of the brassiere to said front side of said undergarment employing a hook positioned on said front side of said undergarment; and securing straps of said brassiere to an outerside of said straps of said undergarment by employing a securing means positioned on said outerside of said straps.

2. A method as in claim 1 wherein the lower opening is defined by a bottom seam which defines a front tongue extending from the front side of the undergarment and a back tongue extending from the back side of the undergarment, wherein each tongue tapers toward the lower end of the undergarment and has an inner surface and an outer surface, said undergarment further comprising a first fastener half on the outside surface of the back tongue near the lower end of the undergarment and a mating second fastener half on the inside surface of the front tongue near the lower end thereof, wherein the back tongue is in the range of about 10 inches to about 16 inches longer than the front tongue, said method further comprising attaching the fastener half on the front tongue to the fastener half on the back tongue.

3. A lady's undergarment to be worn on the upper body and beneath a brassiere, said undergarment having a front side and a back side and being formed from a tubular fabric material defining an upper opening being a neck hole defined by a neck hole seam having a front seam portion and a back seam portion, a single lower opening for receipt of a lower portion of the body, said lower opening defined by a bottom seam, a first arm hole having an upper end and a lower end defined by a first arm hole seam, and a second arm hole having an upper end and a lower end and defined by a second arm hole seam, said undergarment further defining a first strap between the neck hole seam and the first arm hole seam and a second strap between the neck hole seam and the second arm hole seam at the upper end of the second arm hole, wherein, when the undergarment is folded flat, with the front side positioned against the back side, p1 the front seam portion of said neck hole seam is generally U shaped and forms a generally U shaped slot having a length in the range of from about 10 inches to about 14 inches;

the back seam portion of said neck hole seam is generally U shaped to form a generally U shaped slot having a length in the range of from about 10 inches to about 20 inches, each arm hole seam follows an arcuate path from the top of the armhole to the bottom of the armhole to form an opening having a length as measured longitudinally in the range of from about 9 inches to about 16 inches;

a hook is positioned on an outer surface of said front side near a lower end of said neck hole seam to secure to a front portion of a brassiere; and said first and second straps include securing means on an outer surface of said straps to secure a pair of brassiere straps to the said undergarment.

4. A lady's undergarment as in claim 3 which is formed from a 100% cotton fabric having a stretchability in the range of from about 10% to about 50% along the warp and in the range of from about 50% to about 200% along the weft.

* * * * *